United States Patent [19]

Hallam et al.

[11] 4,377,058

[45] Mar. 22, 1983

[54] CURVED HOPPER CAR ROOF

[75] Inventors: Keith J. Hallam, Marietta; Walter J. Marulic, Smyrna, both of Ga.

[73] Assignee: United American Car Co., Atlanta, Ga.

[21] Appl. No.: 185,497

[22] Filed: Sep. 9, 1980

[51] Int. Cl.[3] ..... B61D 7/00; B61D 17/16; B61D 39/00

[52] U.S. Cl. ..... 52/45; 52/48; 105/248; 105/377

[58] Field of Search ..... 52/45, 46, 47, 48, 49, 52/53, 56; 105/247, 248, 358, 377

[56] References Cited

U.S. PATENT DOCUMENTS

| | | | |
|---|---|---|---|
| 1,365,216 | 1/1921 | Anderson | 105/248 |
| 2,034,081 | 3/1936 | Bonsall | 52/46 |
| 2,034,376 | 3/1936 | Bonsall | 52/46 |
| 2,034,385 | 3/1936 | Bonsall | 52/46 |
| 2,073,513 | 3/1937 | Dietrichson et al. | 105/248 |
| 2,092,293 | 9/1937 | Swann | 52/46 |
| 2,225,170 | 12/1940 | Gilpin | 52/56 X |
| 3,035,161 | 5/1962 | Kalt | 52/45 X |
| 3,090,160 | 5/1963 | Shaver et al. | 52/45 X |
| 3,145,665 | 8/1964 | Hamilton | 105/377 |
| 3,176,630 | 4/1965 | Schmeider | 105/377 |
| 3,434,256 | 3/1969 | Eggert, Jr. | 52/56 X |
| 3,442,225 | 5/1969 | Mowatt-Larssen | 52/45 X |
| 3,476,042 | 11/1969 | Carney, Jr. et al. | 105/377 |
| 3,486,277 | 12/1969 | Bauer | 52/46 |
| 3,515,051 | 6/1970 | Pulcrano | 105/247 X |
| 3,599,575 | 8/1971 | Yurdoski | 105/358 |
| 3,844,229 | 10/1974 | Martin | 105/248 |
| 4,275,662 | 6/1981 | Adler et al. | 52/56 X |

*Primary Examiner*—Robert B. Reeves
*Assistant Examiner*—Howard Beltran
*Attorney, Agent, or Firm*—Fay & Sharpe

[57] ABSTRACT

A curved roof construction for a hopper type rail car wherein a plurality of roof support webs extend transversely between opposed car side walls at spaced intervals to each other. These webs provide support for a plurality of large roof panels which are disposed in generally end to end relationships and define the roof surface. The support webs have outwardly curved or bowed conformations between opposed ends thereof so that the roof panels will be similarly bowed. The roof panels are installed so as to define an elongated roof hatch opening generally centrally between and longitudinally of the car side walls. A roof coaming is associated with the roof panels in an adjacent surrounding relationship with the hatch opening. Elongated side plates fixedly secured to the car side walls adjacent to the top edges thereof provide mounting surfaces for the outer side edges of associated ones of the roof panels. The roof support webs include a pair of carline web assemblies disposed adjacent the car end walls slightly inboard of opposed hatch opening ends. In a partitioned type of hopper car, partition webs associated with partition panels which divide the car interior into a plurality of separate compartments comprise other of the support webs. In the case of a partitionless hopper car, additional carline webs are used for other of the support webs.

22 Claims, 16 Drawing Figures

CURVED HOPPER CAR ROOF

BACKGROUND OF THE INVENTION

This invention pertains to the art of roof constructions and more particularly to roof constructions for bulk freight type vehicles.

The invention is particularly applicable to a curved roof construction for a hopper type rail car and will be described with particular reference thereto. However, it will be appreciated by those skilled in the art that the invention has broader applications and may be advantageously adapted to use in other environments.

So-called curved or bowed roof constructions for hopper type rail cars are already known in the art. Such constructions are considered desirable from the standpoint of providing increased roof strength or stiffness while maximizing the percentage of usable volume to actual load volume capacity. Although such curved or bowed roof constructions are broadly known, the prior constructions involved have generally been rather complicated in design, thus requiring many different component parts which often had to be precisely installed to achieve an acceptable roof construction. The foregoing factors undesirably increased car assembly time and overall car costs. Moreover, prior curved roof constructions for hopper cars have not given due and appropriate consideration to maximizing roof strength so as to resist the various forces imparted thereto and thereagainst during normal car use.

The subject invention overcomes the foregoing problems and others to provide a new curved roof constructions for a hopper type rail car which is simple in design, easy to construct, easy to install on a hopper car superstructure and which provides suitable strength characteristics to resist normal operational forces.

BRIEF DESCRIPTION OF THE INVENTION

The present invention provides a curved roof construction for a hopper type rail car wherein a minimum of roof support webs are positioned at spaced intervals along a car centerline to extend generally laterally between opposed car side walls at least adjacent top edge areas thereof. At least some of the support webs include support ribs extending generally laterally of the side walls adjacent the top edge areas with the support webs themselves being curved to some predetermined configuration. The webs are positioned so that the curved areas thereof extend outwardly of a plane defined by the car side wall top edge areas from adjacent opposed support web ends toward the central area intermediate thereof. Roof panels comprised of a plurality of roof sections or continuous roof sheets are supported by the support webs which substantially cover the top area of the car. In the case of the roof sections, each section covers at least a portion of the top area between adjacent support webs and has a curved conformation commensurate with the curvature of the webs. At least some of the roof sections extend from adjacent the top edge area of one car side wall toward the web central areas and at least other of the roof sections extend from adjacent the top edge area of the other car side wall toward the web central areas. In the case of the roof sheets, each sheet is dimensioned and configured so as to be installed in place of a plurality of the roof sections.

In accordance with another aspect of the invention, the inner side edges of the some and the other roof sections adjacent the web central areas may be spaced apart from each other to define a roof trough or hatch opening longitudinally of the car centerline. Where the roof sheets are employed, the opposed inner side edges thereof may similarly be spaced apart to define a hatch opening. A roof coaming may be disposed adjacent to and longitudinally coextensive with each side of the hatch opening. The coaming may be fixedly secured to or integrally formed with the roof panels so as to extend outwardly of the roof construction and provide longitudinal stiffening support for the roof while defining an area adapted to selectively receive a hatch opening cover.

According to a more detailed aspect of the invention, the plurality of support webs comprise first and second end webs associated with the car end walls, and at least first and second carline webs spaced inboard of the first and second end webs adjacent opposite ends of the hatch opening. In the case of a partitioned hopper car, a plurality of partition webs are spaced apart from each other intermediate the first and second carline webs. These partition webs are associated with conventional partition assemblies which divide the car into a plurality of separate compartments. Also, at least the carline webs include support ribs to stabilize the ends of the hatch opening under impact loading conditions. In the case of a partitionless hopper car, additional carline webs are provided intermediate the first and second carline webs.

According to a further aspect of the invention, those surface areas of the at least first and second carline webs as well as any partition webs involved which are exposed to the roof panels have a width dimension sufficient to facilitate positioning of adjacent roof panels thereon in a closely spaced end to end relationship to each other.

In accordance with still another aspect of the invention, the roof coaming comprises a coaming frame having side portions associated with the roof panels on each side of the hatch opening to extend longitudinally thereof. The coaming frame also includes end portions secured to the roof panels adjacent hatch opening ends. In the preferred arrangement, the coaming frame portions include first legs extending outwardly of the associated roof panels and second legs disposed adjacent the outermost ends of the first legs. These coaming frame portions may be fixedly secured to or integrally formed with the roof panels.

According to still a further aspect of the invention, a side plate extends longitudinally of each car side wall adjacent the top edge areas thereof. These side plates each include a roof panel support surface for supporting the associated ones of the roof panels adjacent the outer side edges thereof. Each support surface advantageously tapers upwardly and inwardly toward the car interior from the associated car side wall generally compatible with the curvature of the associated roof panels. The side plates provide sufficient properties to act as side flanges for vertical car bending while providing adequate lateral strength for laterally imposed car loads. In addition, support ribs included with the carline webs extend laterally between and are fixedly secured to the side plates. This arrangement stabilizes the ends of the hatch opening under impact loading conditions and provides direct load paths to the side plates.

The principal object of the invention is the provision of a new and improved curved roof construction for a rail type hopper car which is simple in design and construction.

Another object of the invention is the provision of such a roof construction which is relatively easy to install onto an associated hopper car.

A further object of the present invention is the provision of a curved roof construction which includes appropriate strengthening members and/or components which provide suitable reinforcement for the roof panels and car so that typical operating conditions and forces are readily met and resisted.

Still other objects and advantages for the invention will become apparent to those skilled in the art upon a reading and understanding of the following specification.

BRIEF DESCRIPTION OF THE DRAWINGS

The invention may take physical form in certain parts and arrangements of parts, preferred and alternative arrangements of which will be described in detail in this specification and illustrated in the accompanying drawings which form a part hereof and wherein.

DETAILED DESCRIPTION OF THE PREFERRED AND ALTERNATIVE EMBODIMENTS

Figure 1:
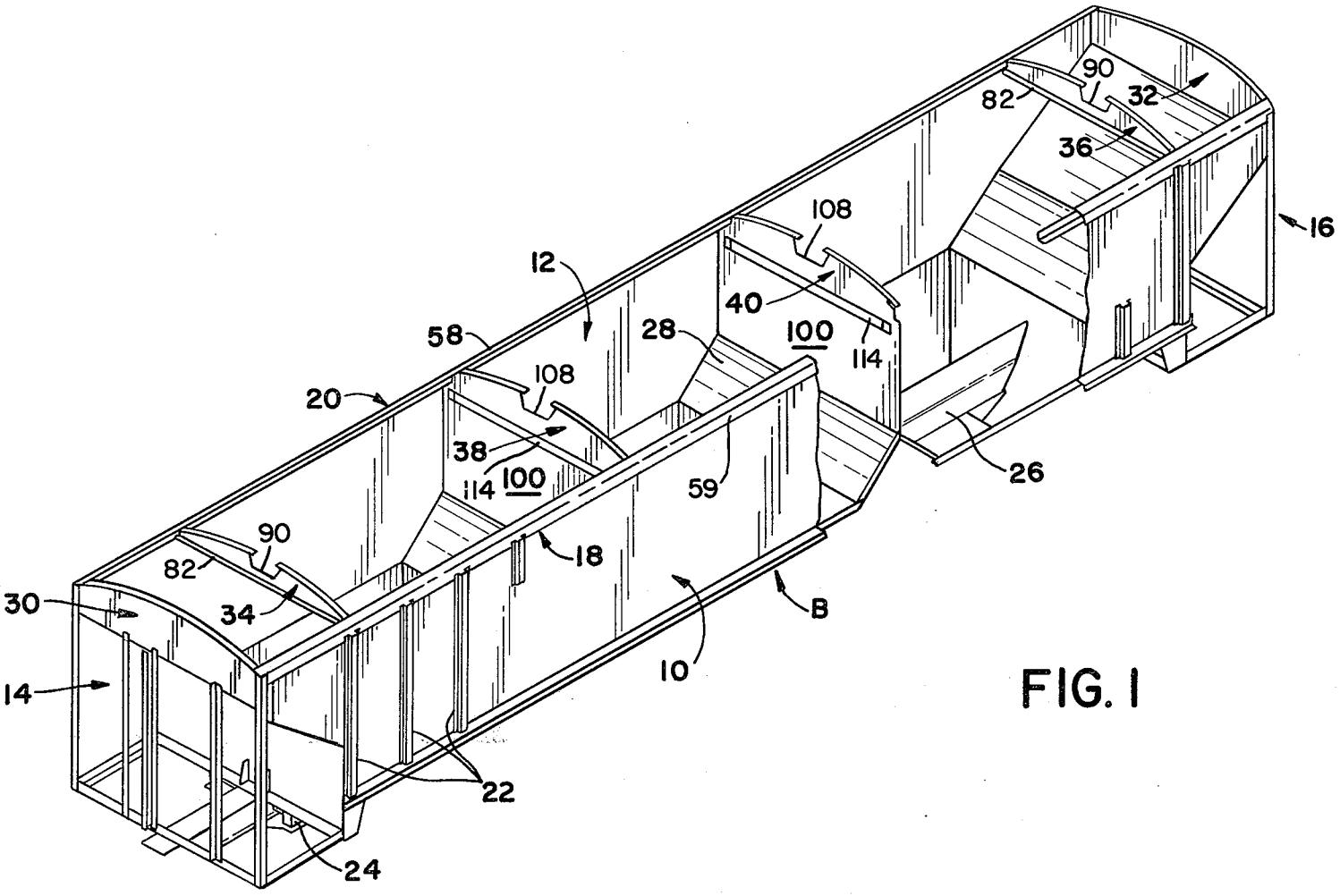
FIG. 1 is a schematic perspective view of a hopper car superstructure which has the roof panels removed and a portion of a side sheet or wall cut away for ease of illustrating other components in the roof construction.
Figures 2, 12:
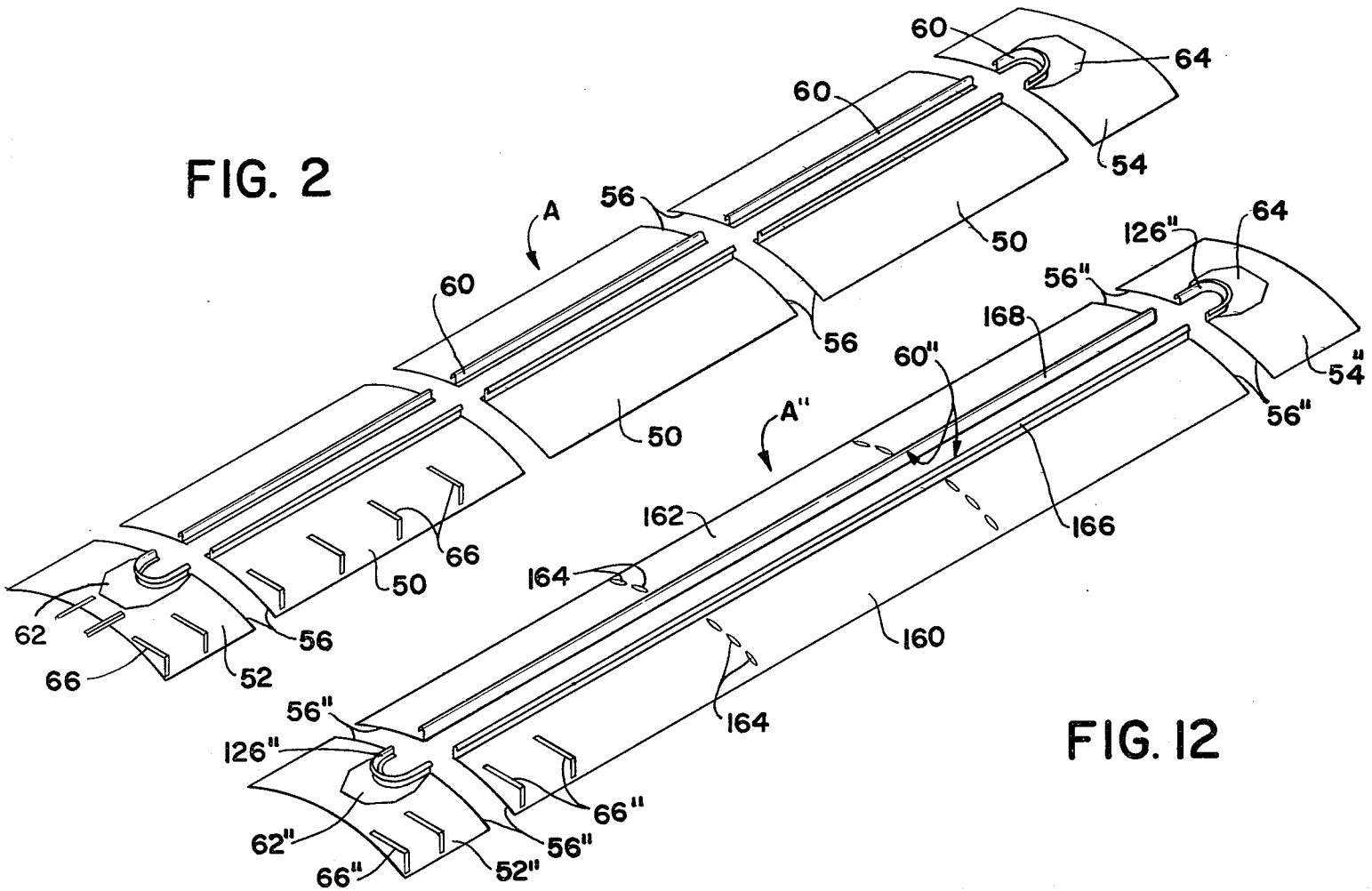
FIG. 2 is an exploded perspective view of one construction of the roof panels and roof coaming.
FIG. 12 is an exploded perspective view of another construction of the roof panels and roof coaming.

Referring now to the drawings wherein the showings are for purposes of illustrating preferred and alternative embodiments of the invention only and not for purposes of limiting same, FIG. 2 shows one embodiment of the subject new curved roof construction adapted for installation on the hopper type rail car B shown in FIG. 1. In FIG. 1, the rail car superstructure has been schematically shown and it will be appreciated that the rail car trucks, couplers, ladders and other ancillary equipment typically associated with hopper cars would be included in the final assembly. As these details do not themselves comprise a part of the invention and for ease of illustration, they have not been included in the FIGURE. Also, and while a partitioned hopper car is shown, it should be appreciated that the subject invention is also considered equally applicable to a non-partitioned hopper car. As used herein, and with regard to the preferred construction, the term fixedly secured contemplates welded interconnection. However, other means or systems for component interconnection could be satisfactorily employed and any use of such alternative means does not depart from the overall intent of the invention.

More particularly, rail type hopper car B includes a pair of opposed, elongated side walls 10,12 and a pair of opposed end wall areas 14,16. The longitudinal centerline of the car extends between end wall areas 14,16 intermediate side walls 10,12. Side wall top edge areas 18,20 extend longitudinally of the side walls adjacent roof construction A. As will be appreciated hereinafter, the roof construction is bowed or curved outwardly from a plane generally defined by top edge areas 18,20. A plurality of stiffeners or stakes 22 are vertically disposed relative to car side walls 10,12 at spaced apart intervals to each other in order to provide strength and stiffening for the side walls. While use of stiffeners 22 does not itself comprise a part of the present invention, it will be appreciated that the lateral spacing between them may be varied as deemed necessary and appropriate to accommodate a particular car construction. However, a spacing of approximately 3′ or so over the entire length of the side walls is typically employed. Moreover, the stiffeners or stakes may be comprised of generally U-shaped channel members having outwardly extending flanges at the terminal or outermost ends of the legs to facilitate ease of assembly onto side walls 10,12. The car also includes a car bolster 24, a center sill 26 and a plurality of slope sheets 28. These components are fairly typical in hopper cars and need not be described in detail herein.

Continuing with reference to FIG. 1, the curved or bowed conformation for roof A is generally obtained by utilizing a pair of end webs 30,32 associated with car end wall areas 14,16, respectively, a pair of carline web assemblies 34,36 and a pair of partition webs 38,40. Each of these webs and web assemblies includes a bowed or curved outer surface which facilitates obtaining the desired curved or bowed conformation. Carline web assembly 34 is spaced slightly inboard of end web 30 and carline web assembly 36 is spaced slightly inboard of end web 32. Partition webs 38,40 are spaced apart from each other intermediate carline web assemblies 34,36. The partition webs comprise a portion of car partitions which are conventionally employed to divide the interior of hopper cars into a plurality of separate compartments. In the car superstructure shown, there are two such partitions so that the car is effectively divided into three compartments. Each compartment, in turn, includes its own slope sheets 28 and lower hatch opening (not shown) in the bottom of the car to accommodate selective compartment emptying or unloading. However, a greater or lesser number of partition assemblies may be used to accommodate different load carrying applications. Moreover, and in the case of a non-partitioned car, partition webs 38,40 could be replaced by additional carline web assemblies similar to assemblies 34,36.

Referring now to FIG. 2, the roof construction shown is defined by a plurality of large roof panels comprised of roof side panels 50 and opposed roof end panels 52,54 which provide the actual covering for the roof area. These panels typically comprise steel plates or the like and may have a thickness on the order of magnitude of ¼" or so. Of course, other materials and thicknesses may be avantageously utilized without in any way departing from the overall intent or scope of the present invention. The end edges 56 of adjacent ones of roof panels 50,52,54 define lateral seam areas or zones as will become more readily apparent hereinafter.

The inner side edge of at least some of roof side panels 50 define one longitudinal side of a hatch opening and the inner side edge of other of the roof side panels 50 define the other side of the hatch opening. Roof end panels 52,54 advantageously include relieved areas for defining the opposite ends of the hatch opening. The outer side edges of roof panels 50,52,54 are adapted to be fixedly secured to one of a pair of side plates 58,59 (FIG. 1) extending longitudinally of side walls 10,12, respectively, adjacent top edge areas 18,20 thereof. Since the various roof panels are to be fixedly supported by the curved or bowed webs, they will take on or assume a similar curved or bowed configuration in the final roof construction.

Finally, a roof coaming generally designated 60 extends outwardly of roof panels 50,52,54 closely adjacent the inner side edges of panels 50 and the relieved areas of panels 52,54 so as to closely surround the entirety of the hatch opening. This coaming advantageously provides longitudinal stiffness locally for the roof structure and provides a sealing surface for the interface of hatch covers (not shown) which are utilized to cover the hatch opening. The coaming may be constructed in several alternative manners and assume several different conformations. Some of these alternatives will be discussed in greater detail hereinafter. As shown in FIG. 2, however, coaming 60 is provided in a plurality of separate sections which are fixedly secured to an associated one of roof panels 50,52,54 as will be described. Reinforcing plates 62,64 are fixedly secured to roof panels 52,54, respectively and closely surround the coaming sections associated therewith for providing additional strength at these areas. Running board brackets 66 are included at spaced intervals on the roof panels for purposes of supporting a running board (not shown). While only a few of these brackets have been shown in FIG. 2, it will be appreciated that all the roof panels will normally include them to accommodate a running board arrangement which generally encircles coaming 60. For ease of illustration, brackets 66 have been deleted from the remaining FIGURES used in showing this particular roof construction.

Figure 3:
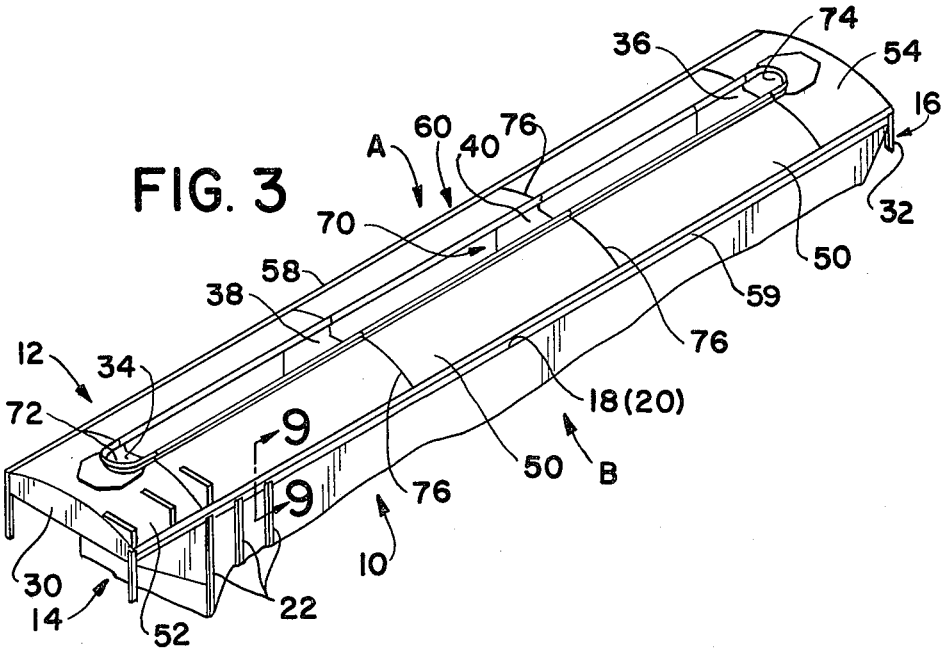
FIG. 3 is a schematic perspective view of a portion of the hopper car superstructure of FIG. 1 which includes the subject roof construction of FIG. 2 installed thereon.

FIG. 3 shows a portion of the car superstructure of FIG. 1 which has the roof construction of FIG. 2 installed thereon. As will be there noted the inner side edges of roof side panels 50 and the relieved areas of roof end panels 52,54 define an elongated hatch opening or trough 70 which extends longitudinally of roof construction A. This opening or trough includes opposed arcuate or curvilinear ends 72,74 adjacent to and inboard of car end wall areas 14,16. The entirety of the opening or trough is closely surrounded by coaming 60. The configuration of the trough ends may be varied as deemed necessary and/or desirable.

In this embodiment of the roof construction, the end edges (edges 56 in FIG. 2) of adjacent ones of roof panels 50,52,54 define lateral seam areas or zones 76. These seam areas are located to extend coextensive with the various webs 30,32,34,36,38 and 40. The cooperating seam areas 76 are slightly spaced apart from each other.

Figure 4:
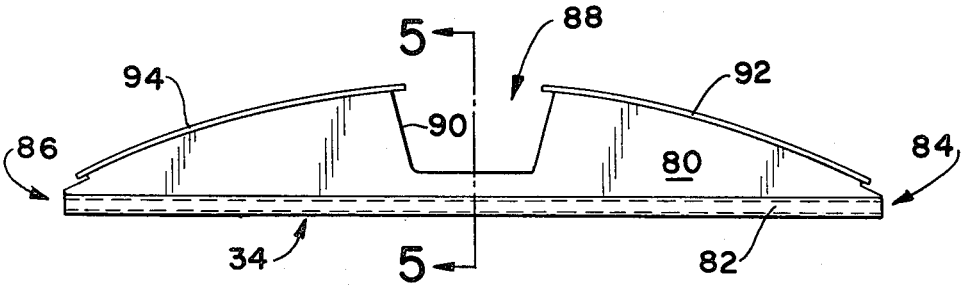
FIG. 4 is a front elevational view of the carline web assembly utilized in the roof construction.
Figure 5:
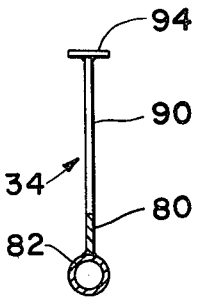
FIG. 5 is a cross-sectional view taken along lines 5—5 of FIG. 4.

FIGS. 4 and 5 show carline web assembly 34 in greater detail, it being appreciated that carline web assembly 36 is identical thereto unless otherwise specifically noted. More particularly, assembly 34 includes a web portion generally designated 80, a support member 82 and opposed web assembly ends 84,86. Web portion 80 curves outwardly from adjacent each of ends 84,86 toward a central area generally designated 88. A relieved zone 90 extends inwardly into the web portion at this central area so as to provide a clearance at and along hatch opening 70. In addition, roof panel mounting or support plates 92,94 are secured to the curved or bowed portions of web portion 80 on each side of zone 90. As best shown in FIG. 5, roof panel mounting plates 92,94 extend outwardly from each side of the web portion in a direction generally normal to the plane thereof and assume a curved or bowed conformation commensurate with that of the web portion (FIG. 4). By way of example, the widths of plates 92,94 may be on the order of magnitude of 2½" or so to provide sufficient roof panel support along the end edges thereof at seam areas or zones 76 (FIG. 3). In the arrangement shown, support member 82 comprises a length of cylindrical tubing having an outside diameter of approximately 2½" or so and is dimensioned so that the opposite ends thereof may be fixedly secured directly to side plates 59,58 (FIG. 1) for reasons which will be described.

Figure 6:
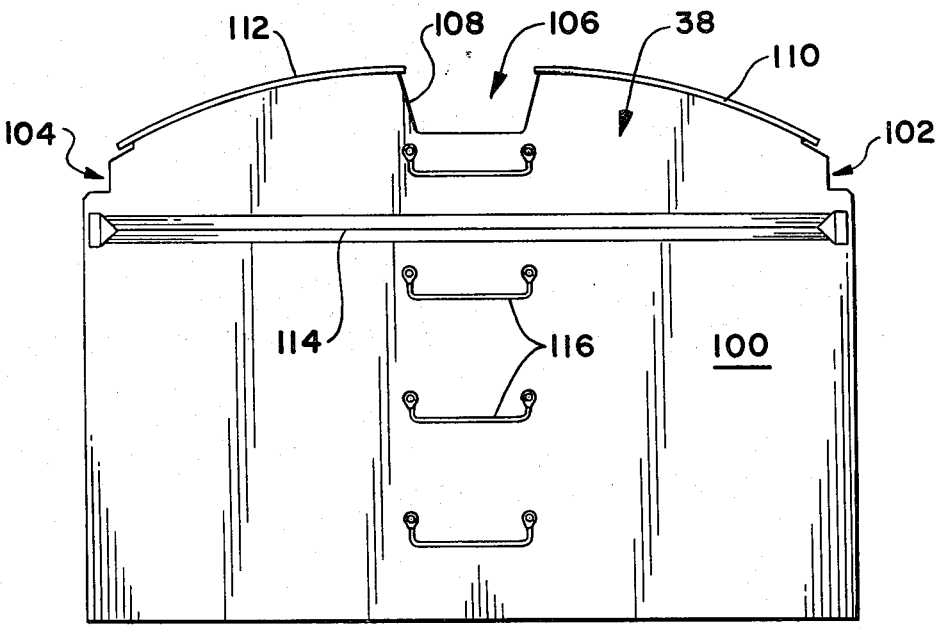
FIG. 6 is a front elevational view of a car partition assembly which incorporates a partition web thereon in accordance with the subject invention.

FIG. 6 shows partition web 38 as part of an associated partition panel, it being appreciated that partition panel 40 is similarly constructed and associated unless otherwise specifically noted. In this FIGURE, the partition panel itself is generally designated 100 and, as previously noted, these panels are conventionally utilized to separate the hopper car interior into a plurality of separate compartments. At least so-called intermediate slope sheets (FIG. 1) are typically associated with the lower end edges of the partition panels to assist in guiding loading out of the rail car through the lower hatch openings (not shown). While two such partition panels which divide car B into three compartments are contemplated in the preferred arrangement, it will be appreciated that a greater or lesser number could be advantageously employed without in any way departing from the overall intent or scope of the present invention.

Partition web 38 includes opposed ends 102,104 which are slightly relieved from the opposed side edges of partition panel 100 itself. As shown, partition web 38 and partition panel 100 are integrally constructed although other structural arrangments and relationships could also be satisfactorily employed. The partition web is curved or bowed outwardly from adjacent ends 102,104 toward a central area generally designated 106. This central area, in turn, includes a relieved zone 108 to provide for and accommodate hatch opening 70 (FIG. 3). The overall conformation of partition webs 38,40 is substantially similar to the conformation of webs 80 in carline web assemblies 34,36.

With continued reference to FIG. 6, a pair of roof panel support plates 110,112 is substantially similar to that previously described above with regard to plates 92,94 included on carline web portions 80. A stiffener member 114 extends laterally across partition panel 100 generally at the interface between that partition panel and the associated partition web 38. Member 114 acts to provide partition support between car side walls 10,12. While this member may take several forms, a length of angle iron fixedly secured to the partition panel as by welding or the like is preferred. A plurality of rungs 116 disposed in a vertical orientation define a ladder which facilitates access to the car interior as is conventional.

All of the various support webs, i.e., end webs 30,32, carline web assemblies 34,36 and partition webs 38,40, have substantially the same amount or degree of curvature incorporated thereinto. This curvature may vary as deemed necessary and/or appropriate to suit the requirements of particular hopper car constructions. However, and merely by way of example, a radius of approximately 6′–8′ is typically contemplated. Moreover, the origin of the radius for each curved portion is laterally spaced approximately 8″ to 12″ or so from the vertical centerline of the particular web involved. Thus, in the case of end support webs 30,32, the foregoing dimensional relationships will provide generally flat web sections at the central areas thereof which generally correspond to relieved areas or zones 90,108 of carline web assemblies 34,36 and partition webs 38,40. The end support, carline and partition webs are mounted to rail car B so that the curved or bowed surfaces thereof define a generally curved roof plane.

Figure 7:
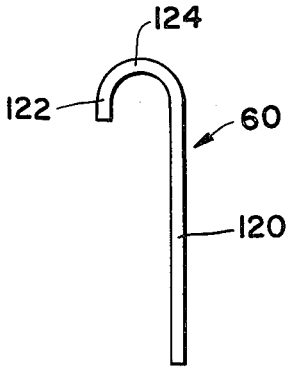
FIG. 7 is a view of the roof coaming frame at one of the joints.

FIG. 7 is an end elevational view of the configuration for coaming 60 (FIG. 2). As previously noted, the coaming in this particular roof construction embodiment is comprised of a plurality of separate coaming sections which are fixedly associated with each of roof panels 50,52,54 (FIG. 2). Each coaming section has the same cross-sectional conformation defined by a frame which includes an elongated first or main elongated leg 120, a shorter second leg 122 and an arcuate portion 124 which interconnects the first and second legs. Thus, the coaming has a generally inverted J-shaped configuration. However, it is possible to utilize other cross-sectional configurations without in any way departing from the intent or scope of the invention. Typically, the length of leg 120 will be on the order of magnitude of 3½″ to 8″ or so and will vary as a function of the type and size of the particular hopper car involved. When installed, the coaming extends upwardly from the roof panels with arcuate portion 124 defining a coaming top.

Figure 8:
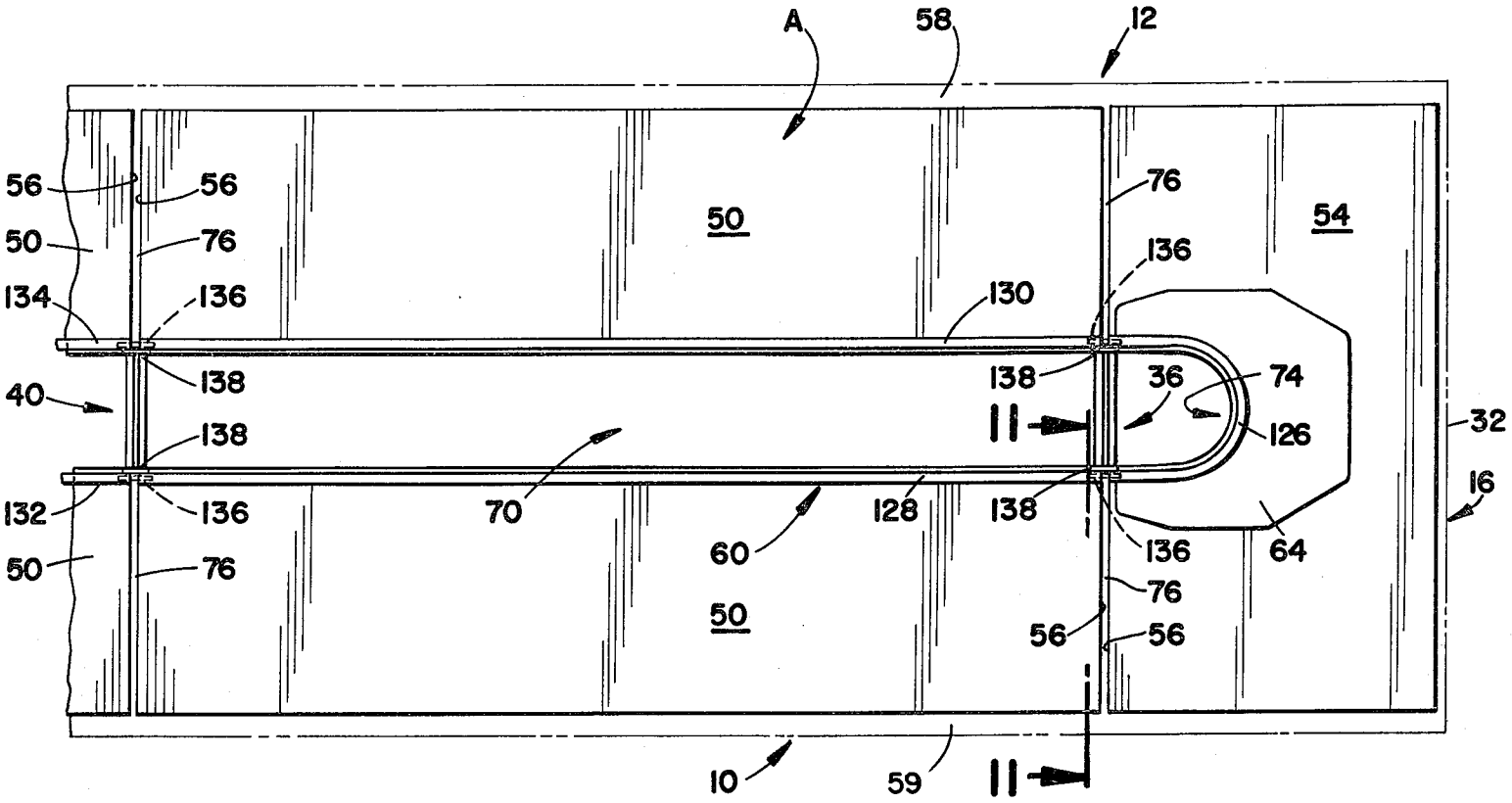
FIG. 8 is a plan view of a portion of the roof assembly shown in FIG. 3.

FIG. 8 is an enlarged plan view of a portion of FIG. 3 adjacent end wall area 16 for showing the installation of the FIG. 2 roof construction. FIG. 8 includes a showing of the relative positioning of end support web 32, carline web 36, partition web 40, hatch opening 70 and associated roof panels 50,54. It should be appreciated that the relationships between the other of the roof components adjacent car end area 14 are substantially identical thereto unless otherwise specifically noted.

In FIG. 8, coaming 60 is comprised of the plurality of coaming sections which are fixedly secured to their associated roof panel and fixedly secured in an end to end relationship with each other. In that regard, an arcuate coaming end portion 126 is provided closely adjacent the relieved area in roof end panel 54 which defines hatch opening or trough end 74. Coaming side sections 128,130 are provided closely adjacent the side edges of the associated roof panels 50 on opposite sides of hatch opening 70 to extend between carline web assembly 36 and partition web 40. In like fashion, coaming side sections 132,134 are associated with the next adjacent roof panels 50 between partition webs 38 (not shown),40. At the time of roof assembly, the various coaming end portions and side sections are connected to each other in an end to end relationship by means of coaming connectors 136 and coaming connector plates 138.

Coaming connectors 136 comprise short sections of tubing adapted to be received within the inside area of arcuate portion 124 (FIGS. 8 and 11) a short distance on each side of the joint itself. In like fashion, connector plates 138 comprise plate members fixedly secured to first legs 120 (FIGS. 8 and 11) of the coaming sections at the generally abutting ends thereof. It should also be noted from FIG. 8 that seam areas or zones 76 between the end edges of adjacent ones of roof side panels 50 and between roof side panels 50 and roof end panels 54 are coextensive with the curved portion of the associated web. The spacing between the adjacent roof panel end edges is approximately ¼″ or so and accommodates ease of roof assembly, particularly when the car superstructure is slightly out of square.

In addition to the arrangement for coaming 60 as described with reference to FIG. 8, it is also possible to construct the coaming from only four separate portions. In that event, the coaming would be comprised of a pair of arcuate end portions such as shown and designated by numeral 126 in FIG. 8 and a pair of elongated side portions which extend longitudinally between the two end portions. With this type of alternative construction, the interconnections between the side and end portions are substantially similar to that already described.

Figure 9:
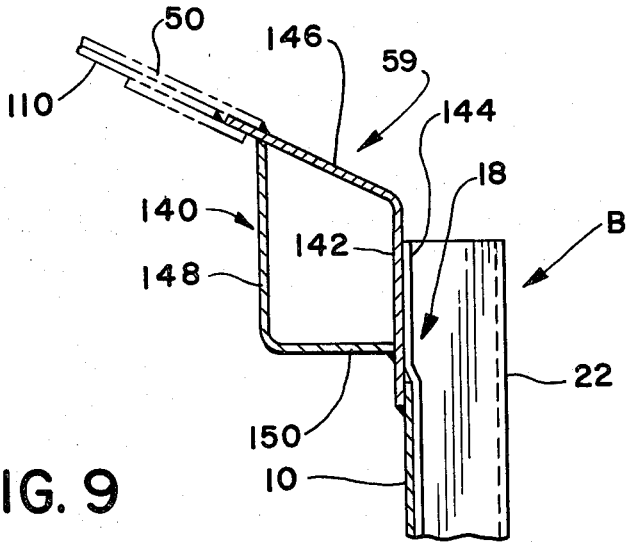
FIG. 9 is a cross-sectional view taken generally along lines 9—9 of FIG. 3 showing one construction and arrangement for the side plates.

FIG. 9 is a cross-sectional view of one configuration and installation for side plate 59, it being appreciated that side plate 58 is oppositely positioned but identical thereto unless otherwise specifically noted. Side plate 59 is defined by an elongated channel-like member 140 having a first side wall 142 fixedly secured to the inside walls or flanges 144 of stiffeners or stakes 22. The stiffeners are, of course, vertically disposed at spaced intervals along the outside of car side wall 10. In addition, a short portion of channel first side wall 142 communicates with and is fixedly secured to side wall 10 adjacent top edge area 18 thereof.

Channel 140 also includes a second side wall 146 adjacent wall 142 which tapers upwardly and inwardly into the interior of the car. The taper angle is calculated so that second side wall 146 will extend generally compatible with the curved or arcuate configuration of the roof panels when they are mounted on the various end support, carline and partition webs. Generally, however, and within the range of curvatures noted hereinabove, an angle on the order of magnitude of 30° or so from the horizontal will be involved.

As is also shown in FIG. 9, roof panel 50 is dimensioned and positioned so that the outer side edge thereof slightly overlaps and is supported by second side wall 146. This arrangement is also generally shown in FIGS. 3 and 8. The various roof panel outer side edges may be fixedly secured to the associated side plates at the overlapping areas therebetween. The amount of overlap is fairly small and may be approximately $\frac{1}{2}''$–$\frac{3}{4}''$ to insure that a tight joint between the side plates and roof panels will be realized. In the preferred arrangement shown, channel 140 is fabricated to include third and fourth side walls 148,150 and thereby present a closed or box-like cross-section. It should be appreciated, however, that many other forms and configurations for channel 140 may be advantageously utilized. Examples of such possible alternatives will be described hereinafter.

Figure 10:
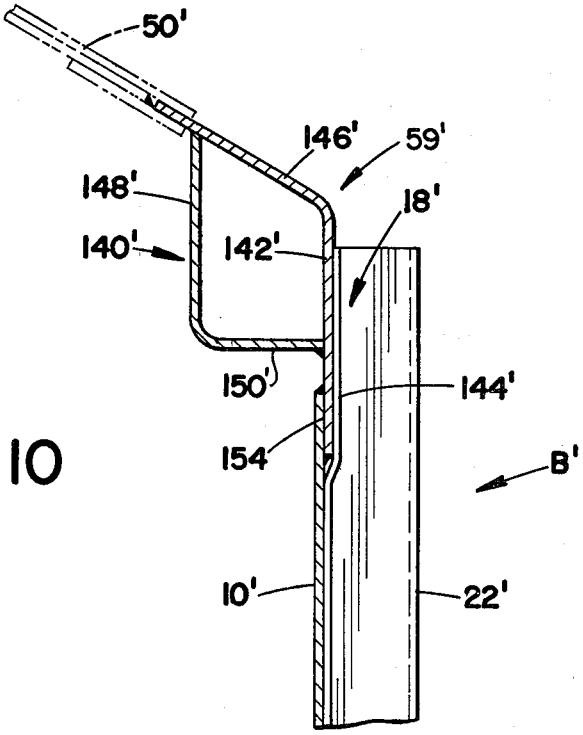
FIG. 10 is a view similar to FIG. 9 showing an alternative installation for the side plates.

FIG. 10 shows a slight modification of the side plate installation of FIG. 9. For ease of illustration and appreciation of this modification, like components are identified by like numerals with a primed (') suffix and new components are identified by new numerals. More particularly, and with reference to FIG. 10, first side wall 142' of the channel is interposed between the inside surfaces of walls or flanges 144' of stiffeners 22' and outside surface 154 of car side wall 10' adjacent top edge area 18'. Such an arrangement requires a slightly different conformation and positioning of stiffeners 22' adjacent the side wall top edge area.

Figure 11:
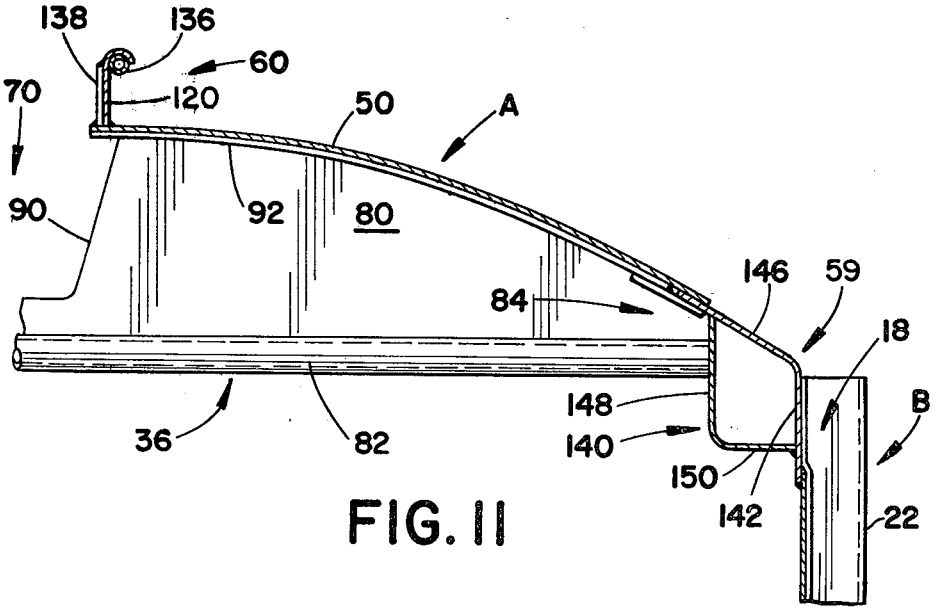
FIG. 11 is a partial cross-sectional view taken along lines 11—11 of FIG. 8 for showing a portion of the complete roof construction adjacent a carline web assembly.

The cross-sectional view of FIG. 11 shows the relative positioning of the various component parts described hereinabove adjacent carline web assembly 36. As will be there noted, support member 82 is fixedly secured at end 84 to side plate 59, it being appreciated that the other end 86 (not shown) is similarly fixedly secured to side plate 58 (also not shown). Roof panel 50 is fixedly secured along one end edge to roof panel mounting or support plate 92 at a seam area 76 (FIG. 8) and is fixedly secured along its outer side edge to channel second side wall 146. Of course, similar relationships occur for the other roof panels which are associated with the various other end support, carline and partition webs and the other side plate.

Roof coaming 60 is disposed adjacent relieved zone 90 shown in FIG. 11 so as to extend longitudinally of hatch opening 70. As will be seen, coaming side section 128 is visible along with connector 136 and connector plate 138 which are utilized to connect the end of section 128 to the end of end portion 126 (FIG. 8).

Insofar as the overall roof construction is concerned, coaming 60 serves two particular functions. First, it provides longitudinal stiffness for the roof and second, it provides a sealing surface for the interface with hatch covers. It should be appreciated that the hopper car includes such hatch covers (not shown) for selectively closing the hatch opening once the car has been loaded. Again, the configuration and/or positioning of the hatch opening may be altered as deemed necessary and/or appropriate to suit particular car requirements.

The curvature of roof panels 50,52,54 increases the panel stiffness to maintain a stable, flutter resistant structure under various environmental conditions. Such conditions include compression due to car bending, vertical accelerations due to impact or simply normal operation conditions.

Side plates 56,58 are designed to have sufficient strength properties to act as side flanges for vertical car bending as well as provide adequate lateral strength for lateral type loading. Lateral loading is generally caused by and is a function of the load or lading placed into the car.

Carline assemblies 34,36 are designed to stabilize the hatch opening under impact loading conditions by providing direct load paths to side plates 59,58 at the opposed rail car side walls. In addition, and during car assembly, the carline assemblies may be used as gauges for side walls 10,12 to insure that the correct width of the car is maintained.

FIG. 12 shows one possible alternative for the overall arrangement of roof panels utilized in the subject new roof construction. For ease of illustration, like components are identified by like numerals with a double primed (") suffix and new components are identified by new numerals. In this Figure, the roof is comprised of a pair of elongated roof side sheets 160,162 which are dimensioned to have a length approximately equivalent to the combined length of the three roof side panels 50 (FIG. 2) on each side of the hatch opening. The roof end panels 52",54" are substantially identical to the structures previously described.

Roof side sheets 160,162 include groups of slots 164 extending transversely thereof at spaced intervals therealong. The spacing of these slots is such that when the roof side sheets are positioned on the rail car, they will correspond with partition webs 38,40 FIG. 1). Thus, opposed end edges 56" of roof side sheets 160,162 will be supported at and affixed to carline assemblies 34,36 with slotted areas 164 being supported at the partition webs. The slots facilitate convenient access to the partition webs to accommodate welding of sheets 160,162 thereto during final weld out.

In addition, the FIG. 12 roof construction shows a slightly modified arrangement for coaming 60". Here, coaming side sections 166,168 are integrally formed in sheets 160,162, respectively, and extend along the entirety of the inner side edges of these sheets. Coaming end portions 126" are similarly integrally formed with roof end panels 52",54". This integral construction reduces the necessity for separately affixing the coaming sections to the associated roof panels at assembly. The interconnections between the ends of coaming side sections 166,168 and the ends of coaming end portions 126" may conveniently be by coaming connectors 136 and connector plates 138 as described above with reference to FIGS. 8 and 11. It will be appreciated by those skilled in the art that all the various coaming constructions herein shown and/or described are readily adapted to use with either one of the roof constructions shown in FIGS. 2 and 12.

Figure 13:
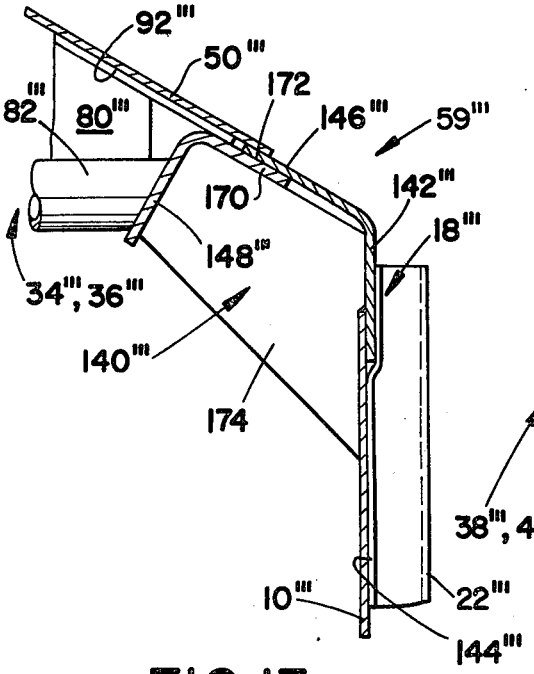
FIG. 13 is a modified side plate construction shown at its interconnection with a carline assembly.
Figure 14:
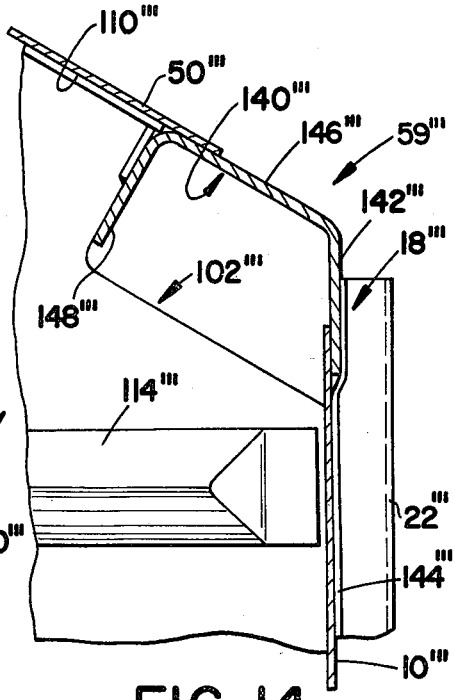
FIG. 14 is a modified side plate construction shown at its interconnection with a partition web.

FIGS. 13 and 14 show alternative conformations for the side plates which may be used in place of the closed or box-like side plates disclosed by FIG. 9 as well as the alternative mounting therefor as shown in FIG. 10. Here, like components are identified by like numerals with a triple primed (''') suffix and new components are identified by new numerals. FIG. 13 shows side plate 59''' at the location of one of carline webs 34''',36''' and FIG. 14 shows side plate 59''' at the location of one of partition webs 38''',40'''.

As will be noted from these two Figures, side plate 59''' is mounted in a manner similar to that of FIG. 10 wherein a side wall of the side plate is interposed between the inside surfaces of walls or flanges 144''' of stiffeners 22''' and the outside surface of car side wall 10'''. The side plate itself comprises a somewhat U-shaped channel 140''' including a first side wall 142''', a second side wall 146''' and a third side wall 148''' so that the bottom area of the channel is open. The second side wall tapers upwardly and inwardly into the car interior generally compatible with the desired curved configuration of the roof panels.

In FIG. 13, channel 140''' is fabricated from two pieces wherein one piece which defines third side wall 148''' includes a leg 170 fixedly secured as at area 172 to the other piece which defines both second side wall 146''' and first side wall 142'''. As also shown in FIG. 13, side frame internal supports such as the one designated 174 may be advantageously positioned at spaced intervals along the channel at least at the locations of carline webs 34''',36''' so as to provide rigidity for and maintain the form of the channel side walls. The channel shown in FIG. 14 is formed from a single piece of material to have the cross-section shown.

In utilizing the concepts of the subject new roof construction, it may be desirable to eliminate the partitions and partition webs so as to obtain a so-called partitionless covered hopper car. In that event, for example, partition webs 38,40 (FIG. 1) along with the associated partition sheets 100 would be replaced by additional carline assemblies similar to those designated 34,36 in FIG. 1. To that end, FIGS. 15 and 16 show cross-sections of still further modified side plate arrangements which advantageously allow the entire roof construction, including the necessary carline assemblies, to be completed prior to positioning and attachment to the rail car superstructure as will be described hereinafter.

Figure 15:
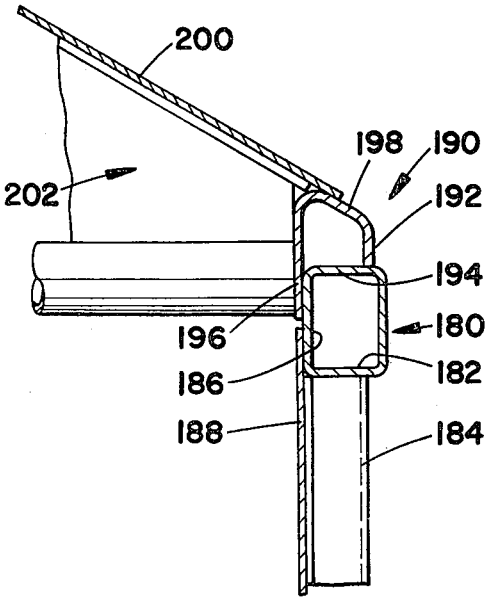
FIG. 15 is a modified side plate construction for a partitionless covered hopper car; and, FIG. 16 is another modified side plate construction for a partitionless covered hopper car.

In FIG. 15, one portion of the side plate is defined by an elongated member 180 having a closed or box-like cross-section. This side plate is supported in position on one side 182 thereof at the top surface of stiffeners or stakes 184 and on another side 186 against the outside surface of car body side wall 188. Another portion of the side plate comprises an elongated somewhat U-shaped channel 190 adapted to be placed in a cooperable position with member 180. In that position, the end of one channel leg 192 engages side 194 of member 180 with a second channel leg 196 closely embracing a portion of member side 186 above the top edge of car body side wall 188. The channel third leg 198 is tapered upwardly and inwardly into the car body interior so as to be generally compatible with the curvature of the roof panels 200. The side edge of car web assembly 202 is fixedly secured to channel leg 196 as shown in FIG. 15.

Figure 16:
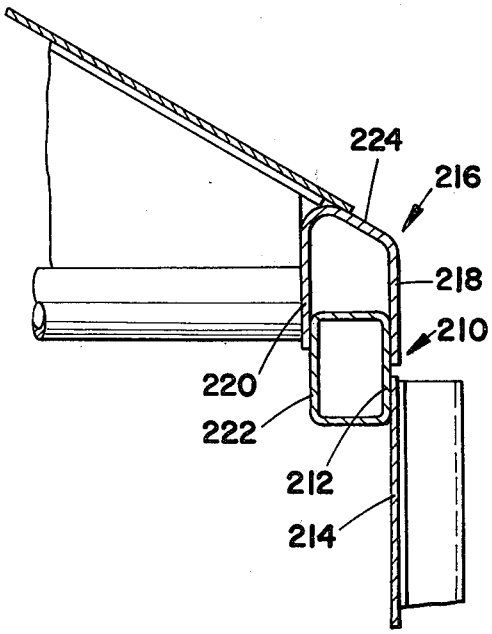

FIG. 16 shows an alternative side plate arrangement wherein an elongated member 210 having a closed or box-like cross section is fixedly secured at side 212 thereof to the inside surface of car body side wall 214 so as to extend slightly above the side wall top edge. The side plate also includes an elongated somewhat U-shaped channel 216 adapted to be placed in a cooperable position with member 210. In that position, opposed channel legs 218,220 closely embrace a portion of member sides 212,222 as shown. Channel leg 224 tapers upwardly and inwardly into the car body similar to the corresponding areas of the other side plate arrangements which have been disclosed. Also, the carline assemblies and roof components are disposed as shown and as previously described.

The side plate constructions of FIGS. 15 and 16 are particularly suited for so-called partitionless covered hopper cars. The relative positions of the side plate components and mounted positions shown in these Figures may be interchanged as deemed appropriate and/or suitable. These side plate arrangements advantageously allow roof assembly to be completed before attachment to the car superstructure, facilitate the roof assembly compensating for camber in the car superstructure and permit all attachment welding to be performed from outside the car.

Turning now to the manner of assembly for the roof components described above and with reference to the roof construction of FIG. 2, coaming 60 may first be constructed and assembled. This coaming may be defined by a longitudinal coaming section associated with each roof panel 50 as shown or a pair of continuous longitudinal sections as described. Of course, both embodiments include opposed coaming end portions associated with roof end panels 52,54 as also shown.

The various coaming sections or portions are positioned in a fixture to insure: (1) the alignment of the sections with each other; (2) that the longitudinal sections are parallel to each other; (3) that the inside width between the longitudinal sections is maintained; and, (4) that the overall length is maintained. Items (3) and (4) are important to insure that the hatch covers fit properly. Once positioned in the fixture, the ends of the sections may be fixedly secured to each other as by coaming connectors 136 and connector plates (FIGS. 8 and 11).

With regard to the curved roof panels which may either comprise six roof side panels 50 and roof end panels 52,54 as shown in FIG. 2 or two roof sheets 160,162 and roof end panels 52'',54'' as shown in FIG. 12, the panels are loaded and positioned in a roof fixture. The coaming assembly is then positioned over the roof panels and a continuous bead of weld applied to the inside of the coaming and roof panels. An intermittent weld is applied on the outboard side.

Following welding, reinforcing plates 62,64 (FIG. 2) can be applied. Running board brackets 66 may be applied to the roof panels in this fixture or at some earlier stage of construction. All hatch cover hinges and locks are positioned and welded into place in this fixture. Also, and in the case of a partitionless covered hopper car, the various carline assemblies may be placed in the roof fixture for roof panel attachment thereto prior to roof positioning on the rail car superstructure.

Various lifting devices can be advantageously used to raise the roof assembly from the fixture to the car superstructure. One such device comprises an elongated beam which includes a plurality of rotatable cross-members. These cross-members may be rotated to a position extending longitudinally of the beam to accommodate lowering thereof through the hatch opening. The cross-members may then be rotated to a position generally normal to the beam to provide lifting points along the inside of the roof assembly. Another type of lifting device comprises an elongated beam which includes a plurality of cross-members extending generally normal therto. These cross-members include means which allow convenient temporary interconnection to selected ones of the running board brackets to provide lifting points. Once the roof assembly has been positioned on the car, the necessary final weld out steps may be completed.

Where the coaming is integrally formed with the roof panels such as is designated 166,168 on roof side sheets 160,162 in FIG. 12, the above described steps for welding the coaming to the roof panels are eliminated. The remainder of the assembly procedure is then substantially identical to that previously described.

In the event the roof construction of the subject invention is to be applied on some special order or limited basis which does not warrant the expense required in constructing the necessary assembly fixtures described above, it is entirely possible to install the roof without the need for such fixtures. In that case, the roof could be applied in sections to the car superstructure. Each section would be comprised of roof panels 50,52,54 (FIG. 2) and 160,162,52″,54″ (FIG. 12) with the appropriate portion or section of coaming 60 or 60″ (FIGS. 2 and 12) attached thereto or formed therewith. Each roof panel would then be directly welded from the outside of the car to the superstructure, i.e., to the associated of the end support webs, carline web assemblies, partition webs and side plates. Since there are no offsets or different slope angles involved in the overall roof construction, each section may be properly positioned even if the superstructure itself is out of square.

The invention has been described with reference to preferred and alternative embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A curved roof construction for a hopper type rail car having opposed elongated side walls and opposed end walls with a car centerline extending between said end walls intermediate said side walls, said roof construction comprising: roof support webs spaced inwardly from said end walls and extending between upper portions of said side walls, said support webs having upwardly curved roof panel support surfaces, roof side panels positioned on opposite sides of said car centerline and having inner edges spaced-apart from one another on opposite sides of said car centerline to define a hatch opening, said side panels extending along said side walls between said support webs, a single roof end panel spanning said side walls and extending between each said support web and an adjacent upper portion of an end wall, and each said end panel having an inner edge adjacent an associated support web with a relieved area therein extending toward the adjacent end wall and aligned with said hatch opening to define hatch opening end portions said roof side panels and said roof end panels supported by said curved roof support surfaces.

2. The roof construction as defined in claim 1 wherein each said roof end panel has a reinforcing plate attached thereto around said relieved area.

3. The roof construction as defined in claim 1 wherein said relieved areas are curved.

4. The roof construction as defined in claim 1 wherein said side panels include a plurality of side panels on each side of said car centerline, and additional support webs located beneath adjacent edges of such plurality of side panels.

5. The roof construction as defined in claim 1 wherein said side panels comprise a single side panel on each side of said car centerline.

6. The roof construction as defined in claim 1 wherein said car side walls have side plates attached to the upper portions thereof and said support webs are attached to said side plates, said side plates including roof panel support portions extending upwardly and inwardly from said car side walls.

7. The roof construction as defined in claim 1 wherein adjacent edges of said end and side roof panels are positioned in slightly spaced-apart relationship on said roof panel support surfaces of said support webs and are individually welded to said support surfaces.

8. The roof construction as defined in claim 1 including upright stiffeners attached to the exterior surfaces of said car side walls, side plates having upright walls attached to said side walls inwardly of said stiffeners and having upper walls extending upwardly and inwardly of said car side walls, said roof side and end panels having edges attached externally of said side plate upper walls.

9. The roof construction as defined in claim 1 including a coaming upstanding from said roof panels in surrounding relationship to said hatch opening.

10. The roof construction as defined in claim 9 wherein said coaming along said side panels is integral with said side panels.

11. A roof construction for rail cars and the like comprising: roof side panels positioned on opposite sides of a longitudinal centerline and having inner edges spaced-apart from one another on opposite sides of said centerline to define a hatch opening, said side panels having outer edges between which a predetermined width is defined, roof end panels positioned at opposite ends of said side panels, each said end panel having a width substantially the same as said predetermined width, said side and end panels having adjacent edges, support webs extending substantially perpendicular to said centerline beneath said adjacent edges and having upper support surfaces to which said adjacent edges are secured, and said end panels having relieved areas extending inwardly from said adjacent edges thereof to a point generally intermediate said end panels in a direction away from said side panels and aligned with said hatch opening to define hatch opening end portions.

12. The roof construction as defined in claim 11 including reinforcing plates attached to the outer surfaces of said end panels in surrounding relationship to said relieved areas.

13. The roof construction as defined in claim 11 wherein said side panels include a plurality of side panels on each side of said centerline, and additional support webs beneath adjacent edges of said plurality of side panels.

14. The roof construction as defined in claim 11 wherein said adjacent edges between said side and end panels are slightly spaced-apart and are individually welded to said support surfaces of said support webs.

15. The roof construction as defined in claim 11 including side plates extending along and beneath the outer edges of said side and end panels, said side plates having upper side plate walls to which said outer edges of said side and end panels are secured, and said support webs having opposite ends attached to said side plates.

16. The roof construction as defined in claim 11 wherein said support webs have opposite ends and include central relieved areas spanning said hatch opening to separate said support surface into a pair of support surfaces on opposite sides of said relieved areas, said support surfaces being curved about centers located on opposite sides of said centerline in outwardly-spaced relationship thereto so that said curved support surfaces become substantially flat at their intersection with said hatch opening.

17. The roof construction as defined in claim 11 including an upright coaming surrounding said hatch opening and hatch end portions.

18. The roof construction as defined in claim 17 wherein said coaming is of generally inverted J-shaped configuration and includes coaming end portions around said hatch end portions and coaming central portions along said hatch opening, said coaming end portions and central portions having aligned ends, and means securing said aligned ends together.

19. The roof construction as defined in claim 11 wherein said support webs include a substantially flat plate web portion having an elongated support member secured thereto, and said support member having opposite ends secured to said side plates.

20. The roof construction as defined in claim 19 wherein said support member comprises an elongated tube welded along the bottom edge of said plate web portion.

21. The roof construction as defined in claim 11 including side plates extending along and beneath the outer edges of said side and end panels, said side plates having upper side plate walls to which said outer edges of said side and end panels are secured, said side plates having upright side plate walls for attachment to the inside area of a rail car side wall.

22. The roof construction as defined in claim 21 including a rail car having side walls and end walls, upright stiffener channels secured to the outer surfaces of said rail car side walls, and said upright side plate walls being secured to said rail car side walls inside of said stiffener channels with said upper side plate walls extending inwardly and upwardly from said rail car side walls.

* * * * *